United States Patent [19]

Stern et al.

[11] 4,061,347

[45] Dec. 6, 1977

[54] SHOCK-ABSORBING SKI POLE GRIP

[75] Inventors: Donald J. Stern; Jon I. Allsop, both of Bellingham, Wash.

[73] Assignee: Allsop Automatic Inc., Bellingham, Wash.

[21] Appl. No.: 691,718

[22] Filed: June 1, 1976

[51] Int. Cl.[2] ..... A63C 11/22

[52] U.S. Cl. ..... 280/11.37 H

[58] Field of Search ..... 280/11.37 D, 11.37 H, 280/11.37 F, 11.37 Z, 11.37 N, 11.37 P; 135/82, 83

[56] References Cited

U.S. PATENT DOCUMENTS

| | | | |
|---|---|---|---|
| 2,478,667 | 8/1949 | Shellhouse et al. | 135/83 |
| 3,486,515 | 12/1969 | Chrysostomides | 135/82 |

FOREIGN PATENT DOCUMENTS

| | | | |
|---|---|---|---|
| 2,055,597 | 5/1972 | Germany | 280/11.37 D |
| 2,130,838 | 1/1972 | Germany | 280/11.37 B |
| 77,061 | 6/1950 | Norway | 280/11.37 H |
| 132,429 | 7/1951 | Sweden | 280/11.37 D |

*Primary Examiner*—David M. Mitchell
*Attorney, Agent, or Firm*—Sherman Levy

[57] ABSTRACT

A shock-absorbing ski pole grip is provided that includes a return spring, a retaining element or screw for holding a piston, cylinder and shaft to a grip, and a piston that is movably mounted in a cylinder on the upper end of the ski pole shaft.

3 Claims, 5 Drawing Figures

Fig-1
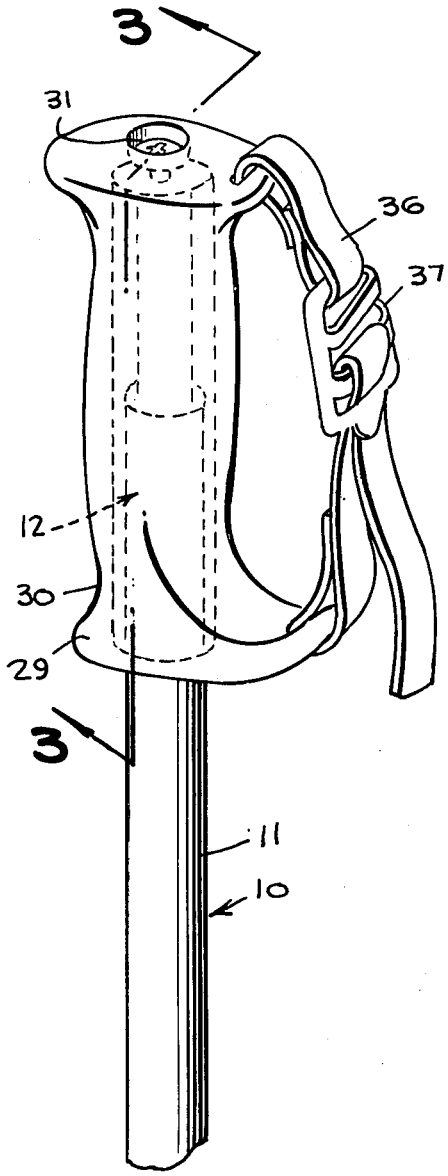
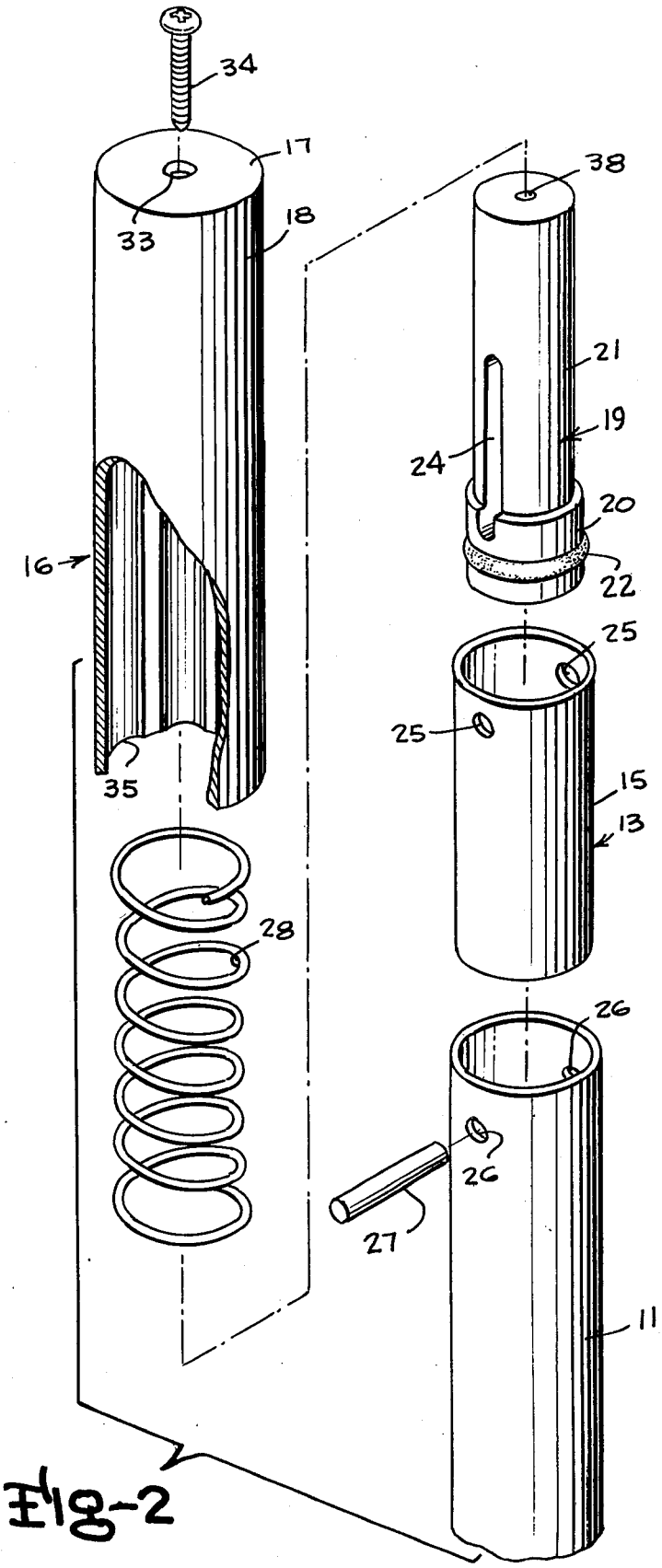
Fig-2

Fig-3
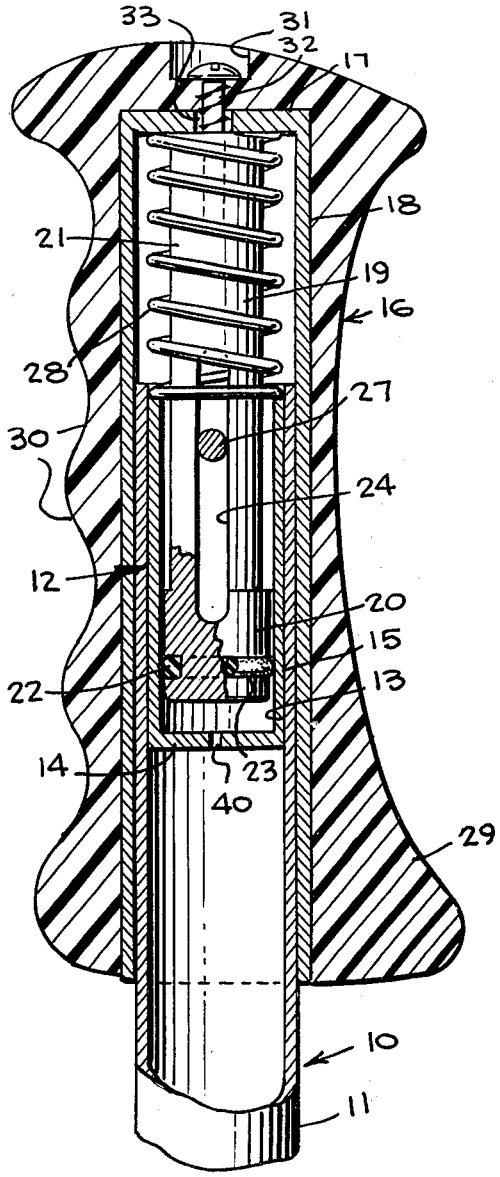
Fig-4
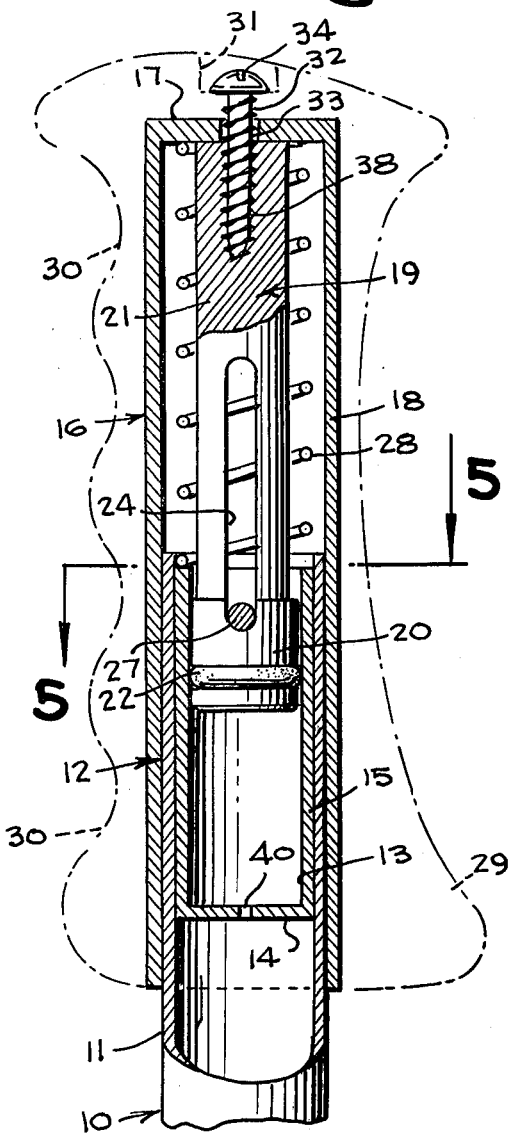
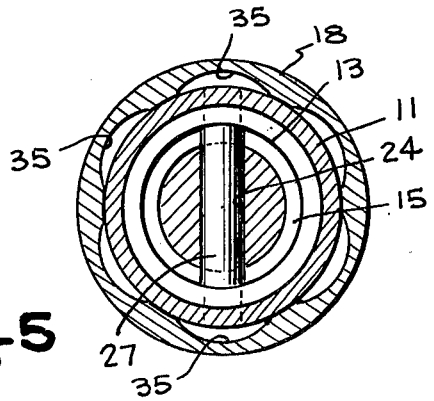
Fig-5

SHOCK-ABSORBING SKI POLE GRIP

BACKGROUND OF THE INVENTION

1. Field of the Invention

The present invention relates to ski poles, and more particularly to a ski pole that has a shock-absorbing means and grip on the upper end of the ski pole.

In accordance with the present invention, there is provided a sleeve as well as a movable piston that coacts with a cylinder so that a cushioning effect or dampening action is provided whereby when skiing, the pole of the present invention will reduce shock as, for example, when the pole is planted in the snow so that the ski pole of the present invention will help prevent shocks from being transmitted into the wrist, elbows, shoulders and the like.

The primary object of the present invention is to provide a shock absorber for a ski pole that will provide a cushioning effect so that jarring or shock will be substantially eliminated when the ski poles of the present invention are being used.

Still another object of the present invention is to provide a shock-absorbing ski pole that is ruggedly constructed and efficient to use and which is relatively simple and inexpensive to manufacture.

A still further object of the present invention is to provide a shock absorbing ski pole grip that provides additional safety features so that, for example, if anyone falls on the pole, the shaft will "give" so that injury to the skiier will be prevented. The ski pole grip functions as a pneumatic system to absorb energy.

Another object of the present invention is to provide a shock-absorbing ski pole that has improved characteristics and advantages as compared to previous ski poles.

Still another object of the present invention is to provide a shock-absorbing ski pole grip that is designed to solve the problem of shock being transmitted from the ski pole shaft to the hand. This is achieved by letting the grip slide on the shaft with a spring or similar shock-absorbing mechanism to both absorb the shock and return the grip to its original position. This function is especially beneficial during a hard pole plant.

Other objects and advantages of the present invention will become apparent in the following specification when considered in the light of the attached drawings.

BRIEF DESCRIPTION OF THE DRAWINGS

FIG. 1 is a fragmentary perspective view of a ski pole and grip equipped with the shock absorber of the present invention.

FIG. 2 is an exploded perspective view showing the parts of the shock absorber, and with parts broken away for clarity of illustration.

FIG. 3 is a sectional view taken on line 3—3 of FIG. 1.

FIG. 4 is a view similar to FIG. 3 but showing the parts in a different position.

FIG. 5 is a sectional view taken on the line 5—5 of FIG. 4.

DESCRIPTION OF THE PREFERRED EMBODIMENT

Referring in detail to the drawings, the numeral 10 indicates a portion of a ski pole tht includes a hollow shaft 11, and a shock absorber 12 is mounted on the upper end of the shaft 11, FIG. 3. As shown in the drawings, there is provided a cylinder 13, and the cylinder 13 includes a bottom portion 14 as well as a cylindrical side portion 15. A sleeve 16 is movably mounted on the shaft 11, and the sleeve 16 includes a top portion or section 17 as well as a cylindrical side section 18. A piston 19 has a portion movably mounted in the cylinder 13, and the piston 19 includes a lower end 20 of increased size or diameter, and the remaining portion 21 of the piston 19 is of reduced diameter. An annular groove 23 is arranged in the lower portion 20 of the piston 19, and an "O" ring 22 is mounted in the groove 23. The "O" ring 22 frictionally engages the inner surface of the portion 15 of the cylinder 13, as shown in the drawings.

The piston 19 is provided with an elongated sot 24 therein. The upper ends of the cylinder 13 and shaft 11 are provided with registering apertures 25 and 26 therein, FIG. 2, and a guide pin 27 extends through these registering apertures 25 and 26 and through the elongated slot 24 in the piston 19 for properly guiding the piston during its up and down movement.

A return spring 28 is circumposed on the piston 19, and the spring 28 has its lower end abutting the upper edge of the cylinder 13, FIG. 3, and the upper end of the spring 28 abuts the top portion 17 of the sleeve 16.

A hand grip 29 has the sleeve 16 mounted therein, and the hand grip 29 has recesses 30 formed thereon for the convenience of the fingers of the skiier. The hand grip 29 has in its upper end a recess 31 that is in communication with an opening 32, there being a registering opening or aperture 33 in the top portion 17 of the sleeve 16 whereby a securing element such as a screw 34 can be extended through these openings and into engagement with the upper end of the piston 19 in order to maintain the parts in their proper assembled position.

As shown in FIG. 5, there is provided cutouts or recesses 35 in the inner surface of the sleeve 16 so that the proper frictional contact is maintained. In FIG. 1 the numeral 36 indicates a strap that is suitably connected to the hand grip 29, and the strap 36 has a buckle 37 associated therewith.

In FIG. 2 the numeral 38 indicates an opening in the upper end of the piston 19 for receiving the threaded end of the holding screw 34.

From the foregoing, it will be seen that there has been provided a ski pole with a shock absorber in the grip thereof, and in use with the parts arranged as shown in the drawings, the ski poles 10 have the shock absorbers 12 in the upper end thereof. Thus, due to the arrangement and construction of the parts, when the lower end of the pole is planted in the snow, the spring 28 and associated parts will permit the parts to move to different positions, such as the position shown in FIG. 3 or the position shown in FIG. 4, whereby a cushion effect is provided so that shocks to the wrist, elbow, shoulders and the like will be prevented or minimized. Thus, the parts can be in the extended position of FIG. 4, or else the parts can move from a position such as that shown in FIG. 4 to the position such as that shown in FIG. 3, or vice versa. The upper end of the spring 28 bears against the top portion 17 of the sleeve 16 that is molded in the grip 29, and the lower end of the spring 28 bears against the upper edge of the cylinder 13, and the cylinder 13 is fixedly mounted in the upper end of the shaft 11. The pin 27 extends through the slot 24 in the piston 19 so that the piston 19 can move up and down in the cylinder 13, and the pin 27 functions as a guide member to help retain the parts in their proper position during their movement.

The "O" ring 22 frictionally engages the inner surfce of the cylinder 13 so as to assure that the parts will not move up or down too quickly. In FIG. 5, the recessed portions 35 assure that there will be the desired proper sliding action between the sleeve 16 and the shaft 11, so that there will be no binding action between these parts. In addition, the recessed portions 35 assure that the proper movement will take place even though foreign matter, dirt or the like may work its way into the vicinity of these parts.

Certain of the parts can be made of other material such as nylon so that, for example, in making certain of these parts of a desired plastic material, they will have the desired strength and in addition, will not be affected by adverse weather conditions.

It is to be understood that the parts can be made of any suitable material and in different shapes or sizes as desired or required.

It will be seen that as shown in FIG. 5, the recesses 35 define ribs therebetween and this construction serves to reduce the area of friction. In addition, the adjacent parts are made of a material having a low coefficient of friction, so that the desired sliding action can readily take place. The shock absorber provides a permanent dampening action due to the provision of the piston in the cylinder and spring and other associated parts. When skiing, the shock-absorbing ski pole of the present invention reduces the shock as, for example, when the poles are planted in the snow so that such shocks will not be transmitted into the skiier's wrist, elbow, shoulder and the like. The ski poles are especially advantageous on conditions such as hard, snow, large moguls and the like. It will be seen that due to the provision of the spring, that the grip can slide up and down on the ski pole shaft so as to provide a shock-absorbing action.

As shown in FIG. 4, for example, there is provided a small orifice 40 in the bottom of the cylinder, and this orifice permits the piston 19 to move downwardly in the cylinder 13 in the proper manner, since air can escape out the orifice 40 into the interior of the hollow shaft 11. When the piston 19 is moved upwardly by the return spring 28, air from the hollow shaft is drawn through the orifice 40 to fill the cylinder 13. This movement of air into and out of the cylinder functions as a pneumatic system operating to absorb energy similar to a dash pot dampening system. The movement of the air is possible due to the fact that the cylinder and shaft assembly is not air tight.

The ski pole grip of the present invention provides improved safety features so that, for example, if the user hits himself or herself on the end of the ski pole, the shaft will "give" so as to prevent injury, and this provides an important safety feature as compared to other previous ski poles.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. In a shock absorbing ski pole, a shaft, a cylinder mounted within the upper end of said shaft and said cylinder including a bottom portion and a cylindrical side portion, a sleeve movably mounted on said shaft, said sleeve including a top section and a cylindrical side section, a piston having a portion movably mounted in said cylinder, and said piston including a lower end of increased diameter and the remaining portion of said piston being of reduced diameter, there being an annular groove in the lower enlarged end of said piston, an "O" ring mounted in said groove and said "O" ring frictionally engaging the inner surface of the side section of said cylinder, said piston having an elongated slot therein, the upper end of said cylinder and shaft having diametrically opposed registering apertures therein, a pin extending through said apertures and though said slot, a return spring circumposed on said piston and said spring having its lower end abutting the upper edge of said cylinder, and the upper end of said return spring abutting the top portion of said sleeve, a hand grip mounted on said sleeve, a holding screw extending through the top portion of said hand grip and through the top portion of said sleeve and into engagement with the upper end of said piston, and a strap connected to said hand grip.

2. The structure as defined in claim 1, wherein the inner surface of the sleeve has a plurality of spaced apart longitudinally extending recessed areas therein that define ribs therebetween.

3. A shock absorbing grip mounted at the upper end of a ski pole comprising a hollow shaft, pneumatic cylinder means having a side wall and a bottom wall mounted within the upper end of said shaft, a hand grip having a sleeve slidably engaging the exterior of the upper portion of said shaft, a piston having a first portion fixed to said sleeve and a second portion slidably engaging said side wall of said cylinder means, said second portion of said piston compressing the air between said second portion and said bottom wall of said cylinder means when said hand grip is moved downwardly, said bottom wall having an orifice to permit a portion of the compressed air to be expelled from said cylinder into said hollow shaft, means connecting said piston to said cylinder means for limited axial movement of said piston with said hand grip relative to said shaft, resilient means positioned between said cylinder means and said hand grip for urging said hand grip and said piston upwardly when the downward force on said hand grip is relieved, and the upwards movement of said second portion of said piston drawing air into said cylinder from said hollow shaft.

* * * * *